US009714788B2

(12) United States Patent
Rigoli

(10) Patent No.: US 9,714,788 B2
(45) Date of Patent: Jul. 25, 2017

(54) ALL TERRAIN INSULATED ROLLING CONTAINMENT AND COOLER SYSTEM

(71) Applicant: Michael Rigoli, Wrentham, MA (US)

(72) Inventor: Michael Rigoli, Wrentham, MA (US)

( * ) Notice: Subject to any disclaimer, the term of this patent is extended or adjusted under 35 U.S.C. 154(b) by 33 days.

(21) Appl. No.: 14/690,962

(22) Filed: Apr. 20, 2015

(65) Prior Publication Data

US 2015/0300721 A1 Oct. 22, 2015

Related U.S. Application Data

(60) Provisional application No. 61/981,434, filed on Apr. 18, 2014.

(51) Int. Cl.
*F25D 23/12* (2006.01)
*F25D 3/06* (2006.01)

(52) U.S. Cl.
CPC ..... *F25D 23/12* (2013.01); *F25D 3/06* (2013.01); *F25D 2400/38* (2013.01)

(58) Field of Classification Search
None
See application file for complete search history.

(56) References Cited

U.S. PATENT DOCUMENTS 3,979,007 A * 9/1976 Thornbloom, Jr. .... A45C 11/20 190/12 R
4,777,697 A * 10/1988 Berndt ..... B60B 33/0002 16/21
5,649,718 A * 7/1997 Groglio ..... B60R 5/04 280/43.17
6,073,789 A * 6/2000 Lundblade ..... B65D 81/3825 220/4.22
6,234,677 B1 * 5/2001 Mogil ..... A45C 7/0077 206/545
6,474,097 B2 * 11/2002 Treppedi ..... A45C 11/20 280/30
7,309,106 B2 * 12/2007 Stallman ..... A47C 15/004 297/188.09
7,997,438 B2 * 8/2011 Kelly ..... A47J 36/2477 220/524
8,069,939 B1 * 12/2011 Metzler ..... B62B 3/007 180/19.1
8,256,242 B1 * 9/2012 Evans ..... A45C 13/262 62/457.7
2005/0279123 A1 * 12/2005 Maldonado ..... A45C 5/02 62/457.7
2006/0178172 A1 * 8/2006 Yuen ..... A45C 11/20 455/575.1
2015/0159938 A1 * 6/2015 Weckerly ..... F25D 23/12 381/334

* cited by examiner

*Primary Examiner* — John Walters
*Assistant Examiner* — Hilary L Johns
(74) *Attorney, Agent, or Firm* — Bay State IP, LLC

(57) ABSTRACT

An insulated rolling cooler which affords the user the ability to easily tow and transport perishable items for an extended period of time, to various locations, and over various terrains, and also affords superior ground clearance capabilities. The insulated rolling cooler includes a multi-functional front wheel mechanism which allows for easy maneuvering of the cooler during travel and the insulated inner liner keeps the perishable items colder for longer. The cup holders, side mesh pockets, and the optional duel storage cavities allow the user to transport more items then any basic cooler.

18 Claims, 18 Drawing Sheets

ALL TERRAIN INSULATED ROLLING CONTAINMENT AND COOLER SYSTEM

CROSS REFERENCE TO RELATED APPLICATION

This application claims the benefit of and takes priority from U.S. Patent Application Ser. No. 61/981,434 filed on Apr. 18, 2014, the contents of which are herein incorporated by reference.

FIELD OF THE INVENTION

The present system and accompanying apparatuses relate to mobile insulated storage vessels, and particularly to a portable high capacity cooler with maximum steering and stability, large diameter wheels, high ground clearance and is insulated for optimal travel and utility.

BACKGROUND OF THE INVENTION

People have been using coolers to transport food and drink items to sporting events, to other people's houses, on camping trips, or to other outdoor events for many years. Generally, these coolers have been basic with either four wheels, or no wheels, and are of a basic rectangular shape made of plastic.

These basic coolers have several limitations. First, those without wheels are hard to transport and, particularly once loaded, are heavy to carry. Furthermore, the coolers with four wheels are hard to steer and difficult to maneuver and do not easily travel over rough terrain.

Second, their basicness limits their storage capacity and therefore limits the amount and/or size of items that can be transported. Lastly, the items placed in many basic coolers cannot last a long time without the addition of ice, often due to the lack of proper insulation.

SUMMARY OF THE INVENTION

The instant system, as illustrated herein, is clearly not anticipated, rendered obvious, or even present in any of the prior art mechanisms, either alone or in any combination thereof.

The current system includes features that afford the cooler apparatus complete mobility and superior storage in numerous manners. First, the current system and accompanying apparatuses include at least three large diameter rubber, or other flexible polymer based material, wheels which allow for easy steering and handling, and maximum stability. The three large diameter rubber wheel configuration features, in at least one embodiment, a large diameter rubberized wheel, allows for the cooler to be easily transported by any user. Additionally, the wheels may be pneumatic or solid rubber, rugged tires, which, in conjunction with the high ground clearance feature, allows the cooler to be transported over most terrains. The rear wheels also contain a brake mechanism to keep the cooler in place. Furthermore, the current system and accompanying apparatuses include a collapsible three piece adjustable handle for towing.

Secondly, the current system may comprise cup holders, each comprising drainage apertures, and an option for dual storage chambers, and side mesh pockets for increased storage space and options. These storage options allow for 55 quarts of storage capacity. Additionally by simply increasing the length of the cooler, the identical beneficial system can be offered in other sizes, i.e. 80 quart, etc.

Lastly, the current system uses closed cell foam thermal technology for increased insulation. This allows the items being stored in the cooler to last for much longer durations, and in warmer climates, than basic coolers.

Therefore, it is an object of the instant system to provide a high capacity cooler that travels over even rough terrain, with maximum steering and stability, and is insulated for optimal travel and utility.

It is a further object of the instant system for the cooler to have three wheels, which are pneumatic, rubberized, polymeric rugged tires.

It is a further object of the instant system for the cooler to have a brake mechanism on at least one, or each of the rear two wheels.

It is a further object of the instant system for the cooler to have a collapsible articulating three piece handle for towing.

It is a further object of the instant system for the cooler to include multiple cup holders.

It is a further object of the instant system for the cooler to include two side mesh pockets for increased storage.

It is a further object of the instant system for the cooler to incorporate optional dual chambers, adaptable to wet or dry storage, wherein the divider is stored under the primary lid of the cooler.

It is a further object of the instant system for the cooler to have a secondary, smaller, lid for the optional second wet or dry storage chamber.

It is a further object of the instant system to introduce a cooler incorporating materially enhanced ground clearance and larger, highly capable wheel configurations.

It is a further object of the instant system to introduce a cooler possessing an interior liner of closed cell foam thermal technology for increased insulation.

It is a further object of the instant system to introduce a lid seal gasket for the lid systems.

It is a further object of the instant system to include the addition of an integrated adjustable elastic tie-down strap to allow fastening (side to side) of items like fold-up chairs etc. on the top of the cooler. This stores in the side mesh pocket when not in use.

It is also an object of the instant system possessing an integrated, removable, waterproof and rechargeable Bluetooth® speaker system that is Smartphone compatible. The system may additionally include a USB port to support the charging of other devices such as Smartphones and this USB port may be located under the front handle mechanism.

It is a further object of the instant system to utilize at least one, rearwardly disposed, integrated mesh storage pocket under the rear lift handle to increase overall storage capacity.

It is also an object of the present system to incorporate an integrated bottle opener in the rear handle.

It is an additional object an integrated, removable, waterproof light system, safely located within the underside of the main lid. This will light the interior of the cooler as well as act as a flash light by removing.

Finally, in an additional embodiment of the instant system, the mesh side pockets be attached with an external bracket.

There has thus been outlined, rather broadly, the more important features of the versatile cooler systems in order that the detailed description thereof that follows may be better understood, and in order that the present contribution to the art may be better appreciated. There are additional features of the system and accompanying apparatuses that will be described hereinafter and which will form the subject matter of the claims appended hereto.

In this respect, before explaining at least one embodiment of the system and accompanying apparatuses in detail, it is to be understood that the system and accompanying apparatuses are not limited in its application to the details of construction and to the arrangements of the components set forth in the following description or illustrated in the drawings. The system and accompanying apparatuses are capable of other embodiments and of being practiced and carries out in various ways. Also, it is to be understood that the phraseology and terminology employed herein are for the purpose of description and should not be regarded as limiting.

These, together with other objects of the system and accompanying apparatuses, along with the various features of novelty, which characterize the system and accompanying apparatuses, are pointed out with particularity in the claims annexed to and forming a part of this disclosure. For a better understanding of the interactive systems, apparatuses and accompany methods, the operating advantages and the specific objects attained by usage, reference should be made to the accompanying drawings and descriptive matter in which there are illustrated preferred embodiments of the system and accompanying apparatuses.

DETAILED DESCRIPTION OF THE SEVERAL EMBODIMENTS

Figure 1:
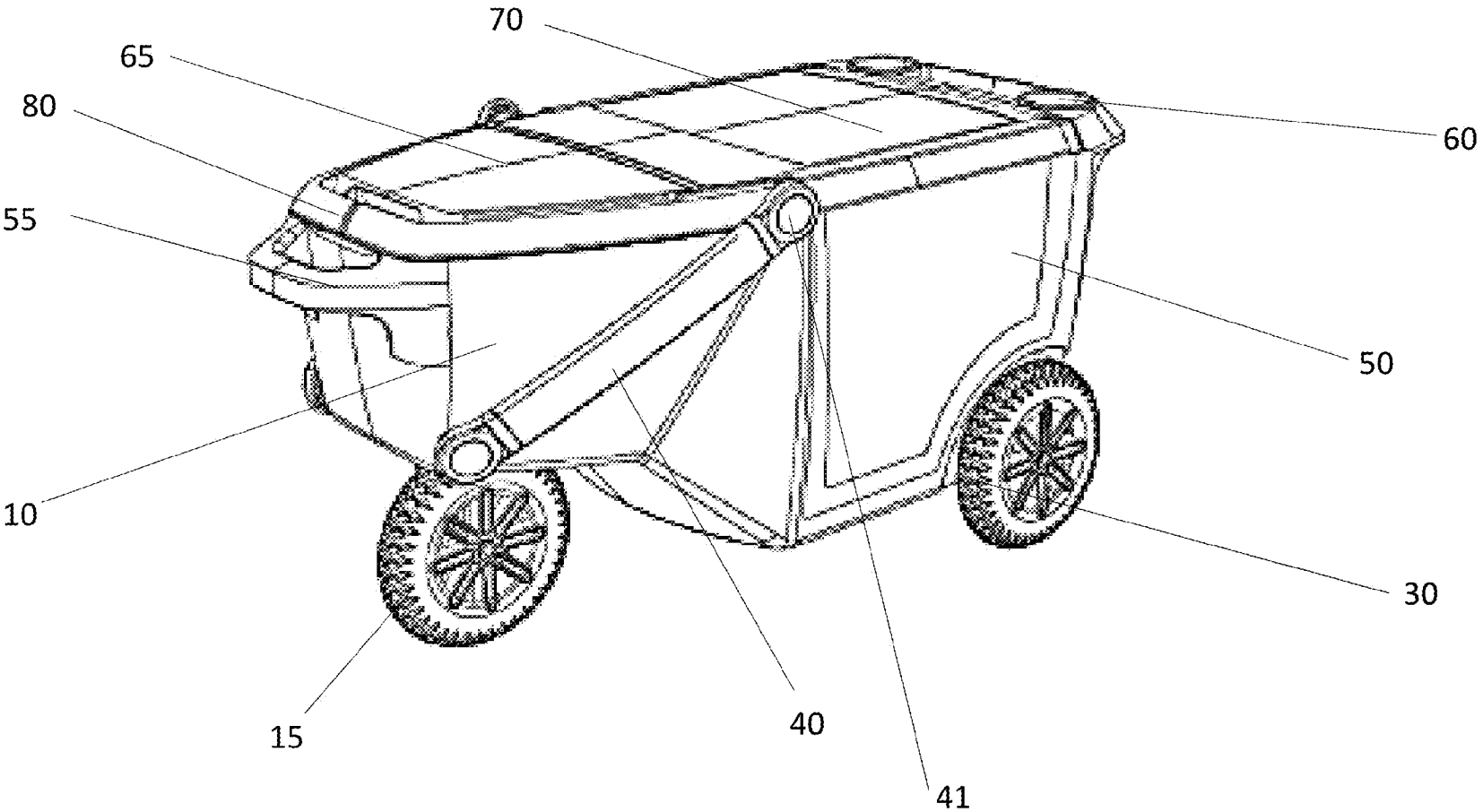
FIG. 1 is a perspective view of the invention.
Figure 2B:
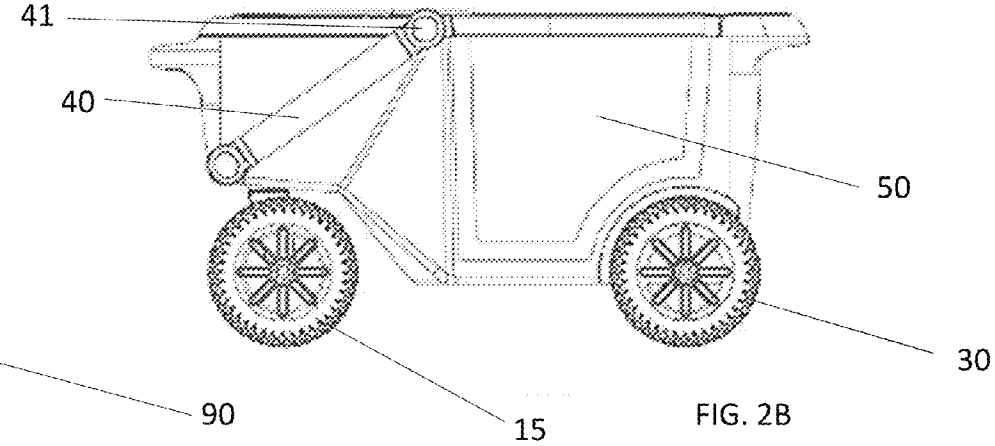
FIG. 2B is a side view of the invention.
Figure 2C:
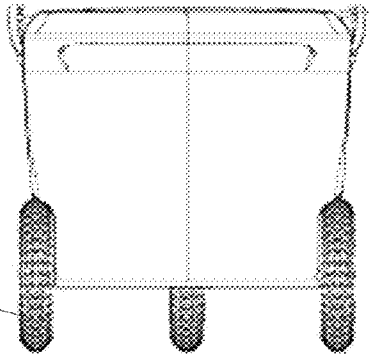
FIG. 2C is a rear view of the invention.
Figure 2A:
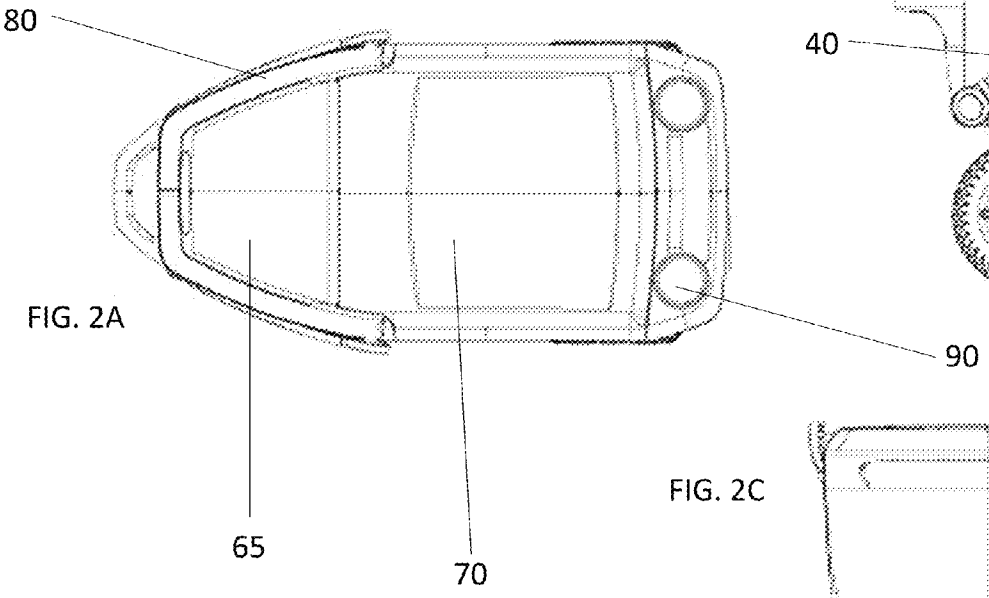
FIG. 2A is a top view of the invention.

The detailed description set forth below is intended as a description of presently preferred embodiments of the system and does not represent the only forms in which the present system may be construed and/or utilized. The description sets forth the functions and the sequence of the steps for producing the system and accompanying apparatus. However, it is to be understood that the same or equivalent functions and sequences may be accomplished by different embodiments also intended to be encompassed within the scope of the system.

FIGS. 1-11 depict various viewpoints of the present system and accompanying apparatuses and the corresponding components. The several advantageous elements and salient objections, clearly illustrated within, including portable high capacity cooler with maximum steering and stability, large diameter wheels, high ground clearance and is insulated for optimal travel and utility.

FIGS. 1-3 and 6A-6B depict the exterior body 10 and its components. The present system includes an exterior body 10 with two rear wheels 30 and one front swiveling wheel 15. The exterior body 10 has two cup holders 60 on the top rear, and each side of the body 10 has a mesh pocket 50. The exterior body 10 also has a control arm 40 that attaches to the handle 80. Furthermore, the exterior body 10 may comprise an additional towing mechanism 55.

Figure 3:
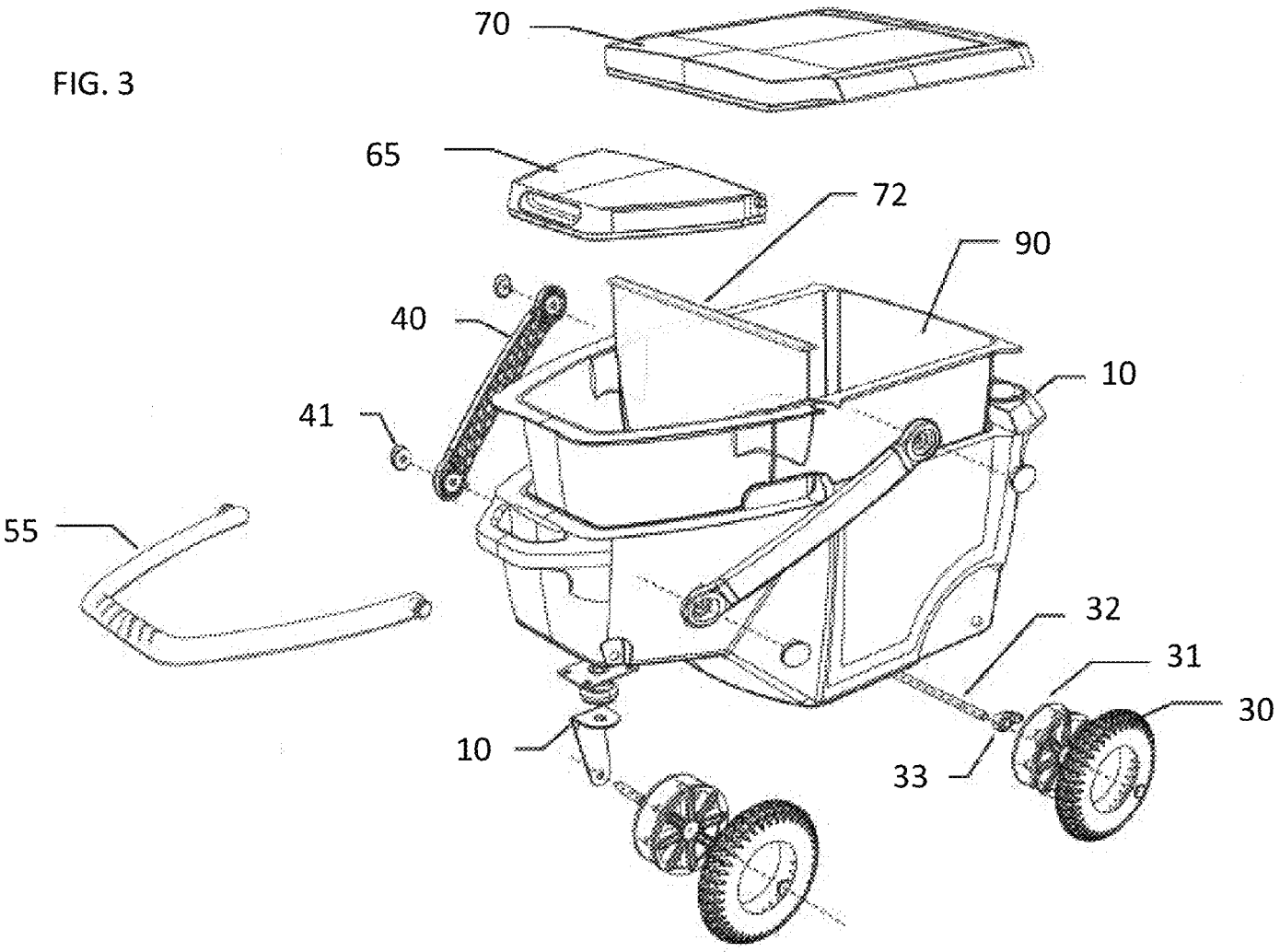
FIG. 3 is an exploded view of the invention.
Figure 4B:
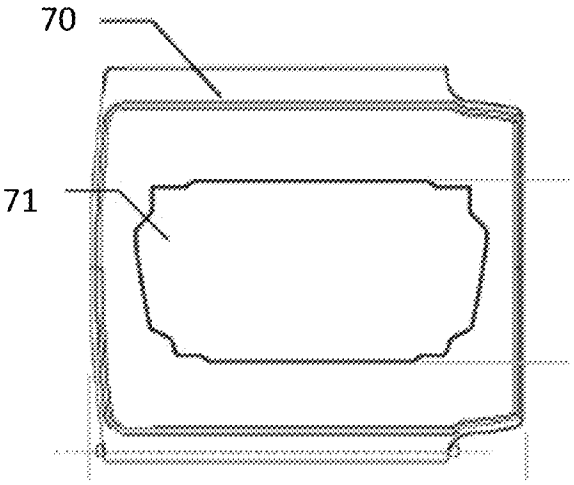
FIG. 4B is a bottom view of the primary lid.
Figure 4D:
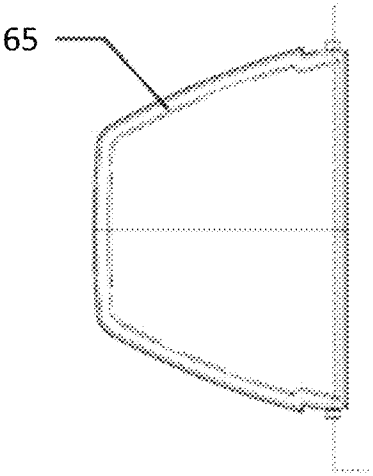
FIG. 4D is a bottom view of the secondary lid.
Figure 4A:
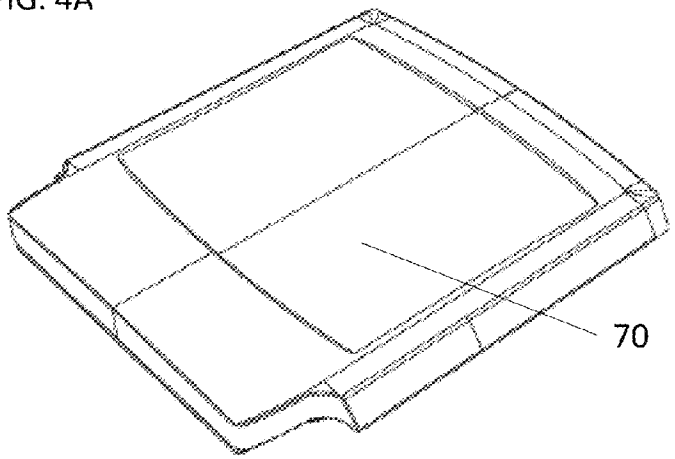
FIG. 4A is perspective view of the primary lid.
Figure 4C:
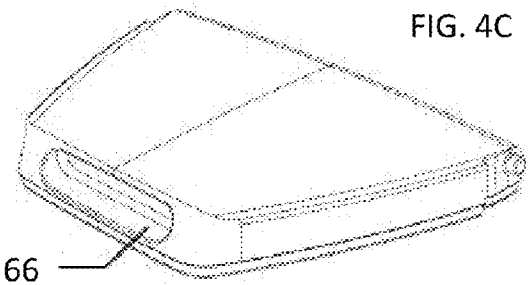
FIG. 4C is a perspective view of the secondary lid.
Figures 5A, 5B:
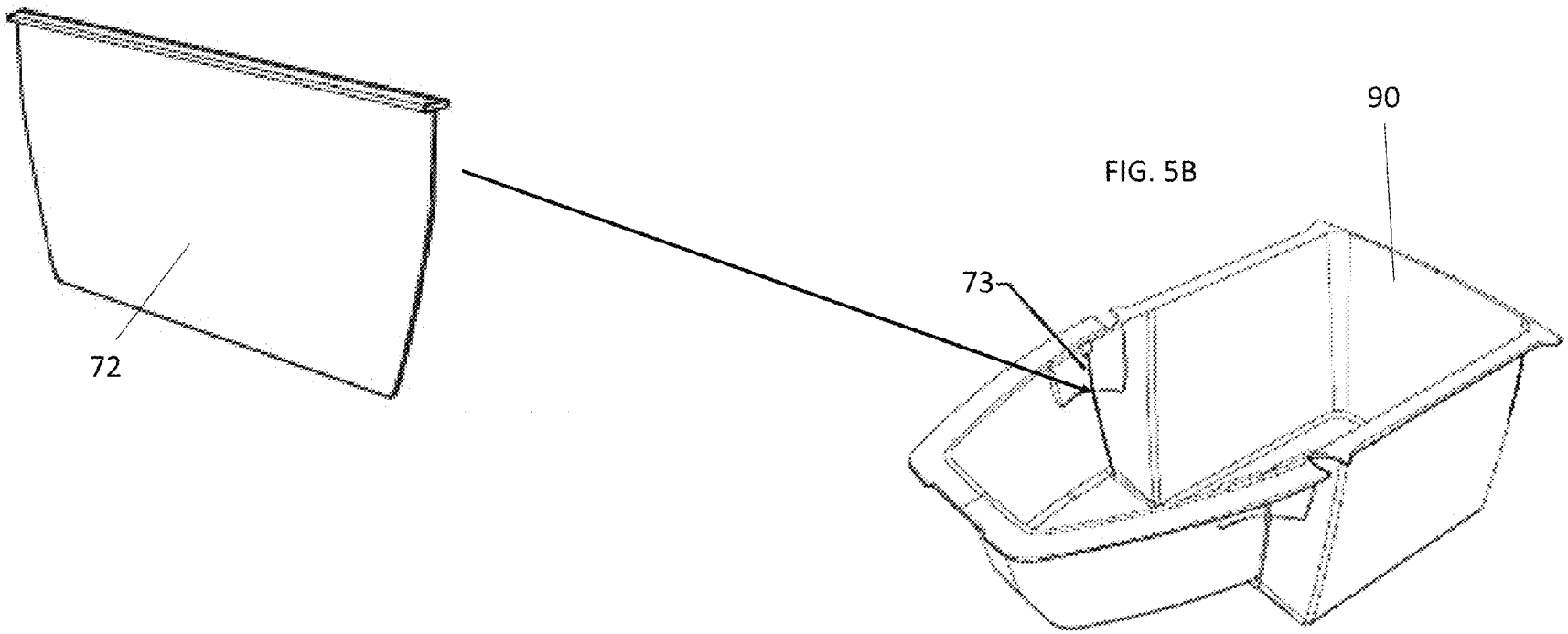
FIG. 5A is a perspective view of the interior divider.
FIG. 5B is a perspective view of the interior liner with a molded recessed slot that accepts the interior divider.
Figure 6B:
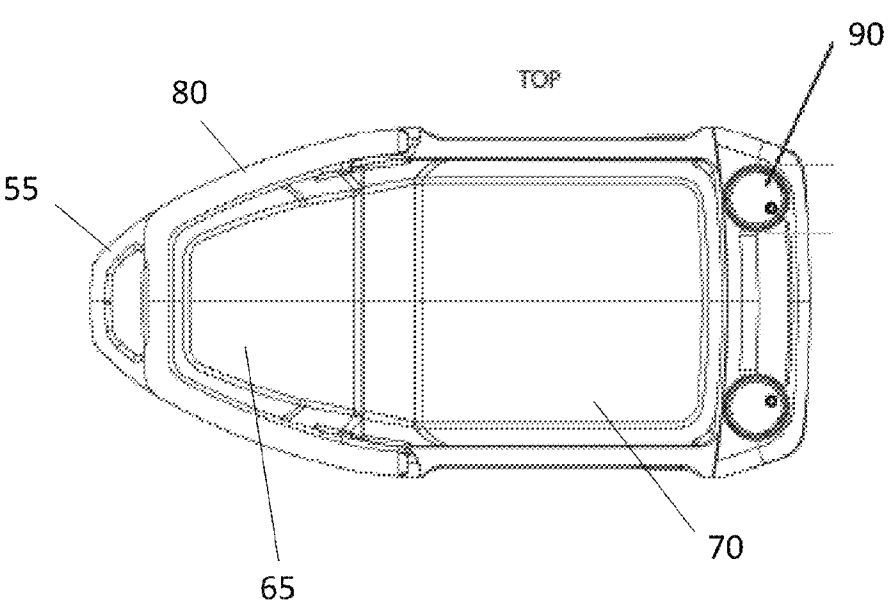
FIG. 6B is a top view of the exterior body.
Figure 6A:
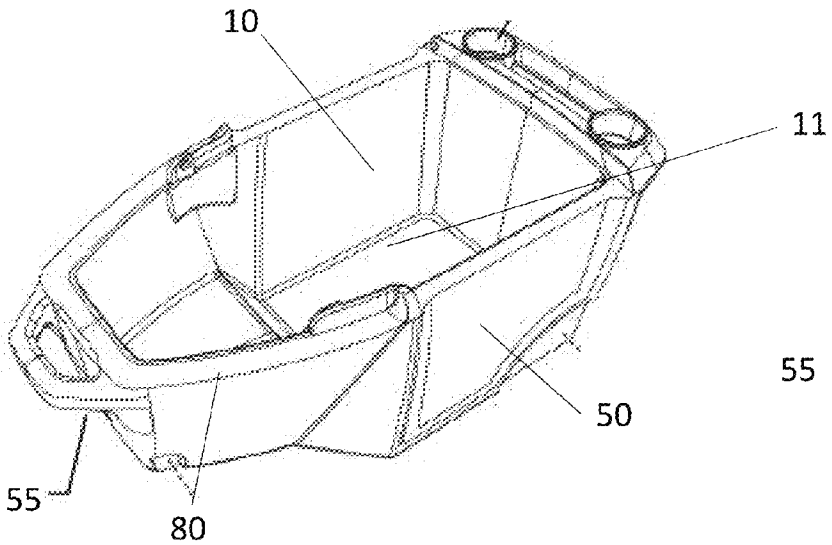
FIG. 6A is a perspective view of the exterior body.
Figure 7B:
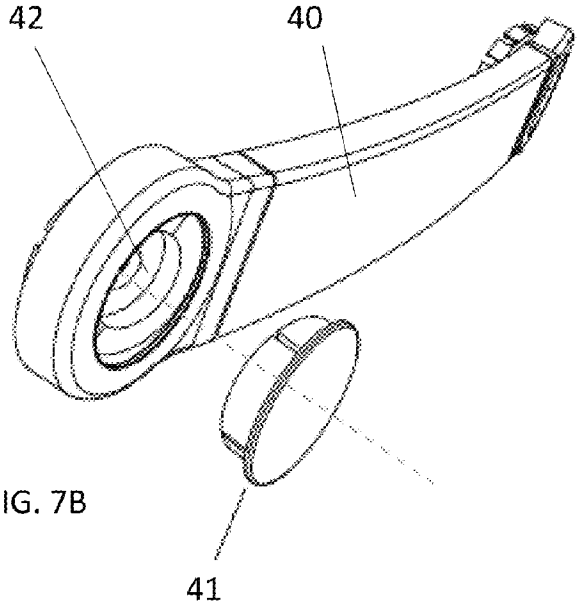
FIG. 7B is a perspective view of the control arm cover clip.
Figure 7A:
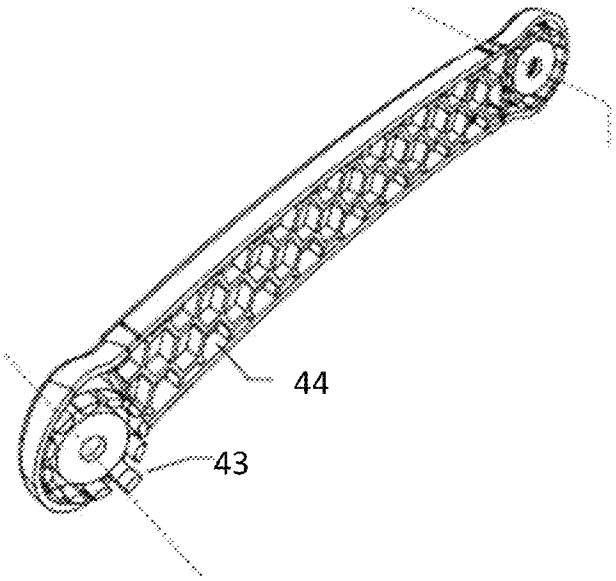
FIG. 7A is a perspective view of the control arm.
Figure 8B:
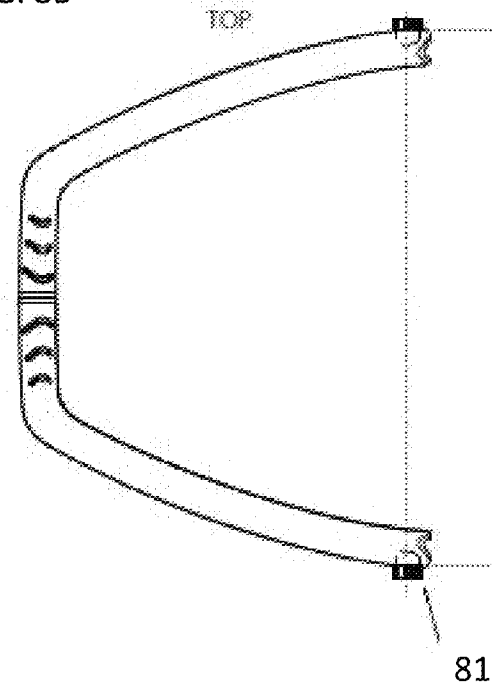
FIG. 8B is a top view of the handle.
Figure 8A:
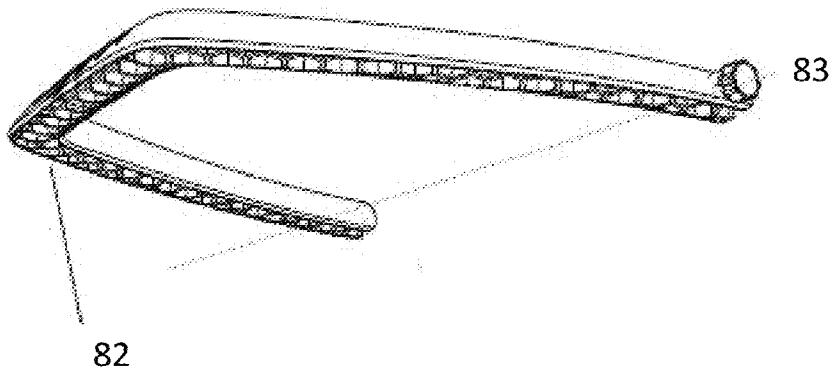
FIG. 8A is a perspective view of the handle.

FIG. 3 depicts the components of the wheels of the present system. The rear wheels 31 are fitted with a tire 30 and the two rear wheels are connected with a rear axle 32. A brake 33 is affixed to each wheel 31. The front wheel 16 too is fitted with a tire 15 and contains an axle 17.

FIGS. 4A-4D and 5A-5B depict the primary lid 70 and a secondary lid 56. Each lid opens up to a storage cavity 11. The storage cavity 11 can be divided into two separate cavities. The interior divider 72 is placed into a molded recessed slot 73 that accepts the interior divider 72. The molded recess slot 73 is located in the interior liner 90. When it is not being used, the interior divider 72 is stored in a cavity 71 under the bottom of the primary lid 70.

The interior liner 90 is placed in the exterior body 10, which is designed to the items stored in system cold.

FIGS. 7A-7B, 8A-8B, 10A, and 10B depict the arm control and handle. The arm control 40 has hexacomb interior ribbing 44 and molded tabs 43 that allow for detenting rotation. The cover clips 41 snap into a cavity 42 on the control arm 40. The control arm 40 is mounted to the exterior body 10.

The handle 80 has a hexacomb interior ribbing 82 on its underside. The handle 80 mounts to the end control arm 40 that is not mounted to the exterior body 10. The handle 80 comprises a male end projection feature 81 that interacts with the detent mechanisms located within the control arm 42. The point where the handle 80 mounts to the control arm 40 is a hinge pivot 83 which allows the handle 80 to be in an opened or closed position.

Figure 9B:
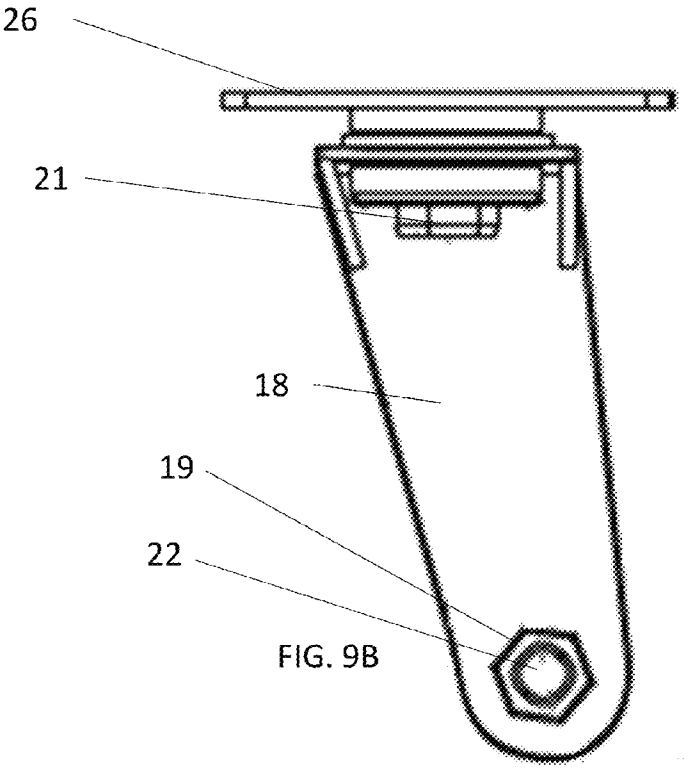
FIG. 9B is a side view of the from swivel assembly.
Figure 9A:
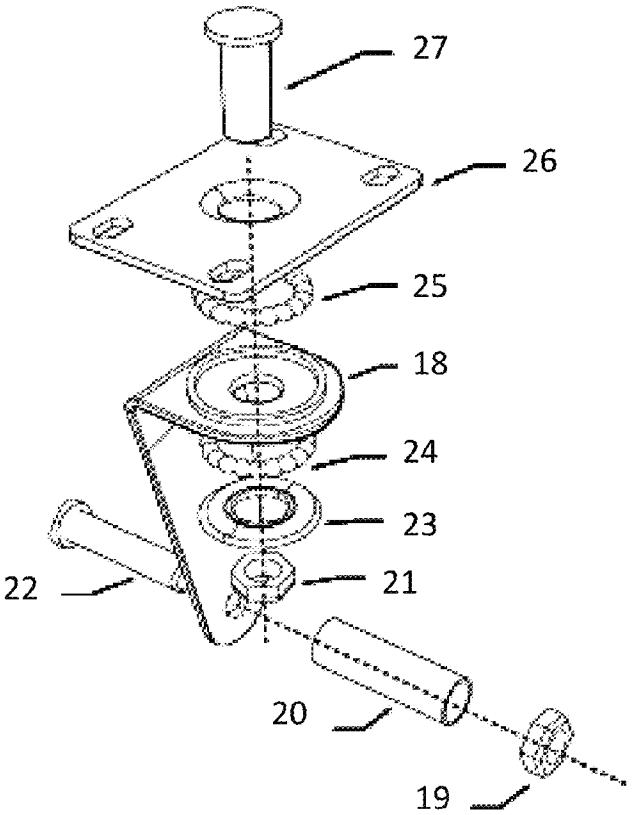
FIG. 9A is an exploded view of the front swivel assembly.
Figure 10B:
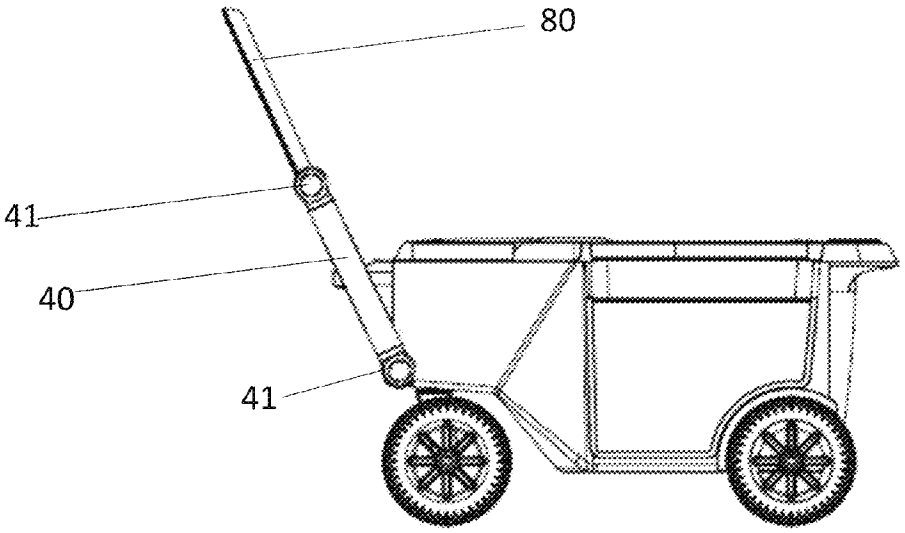
FIG. 10B is a view of the handle in an open position.
Figure 10A:
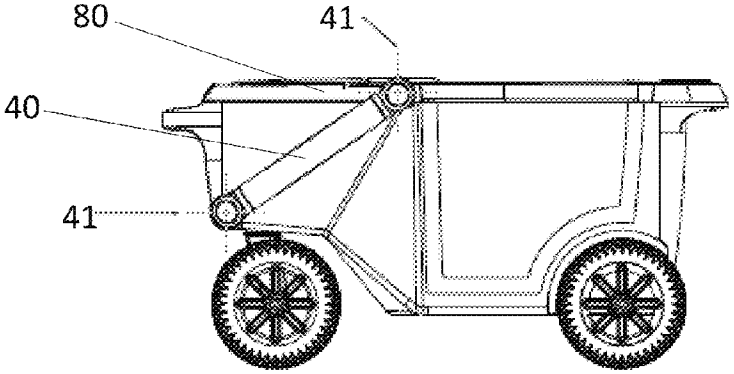
FIG. 10A is a view of the handle in a closed position.
Figure 11:
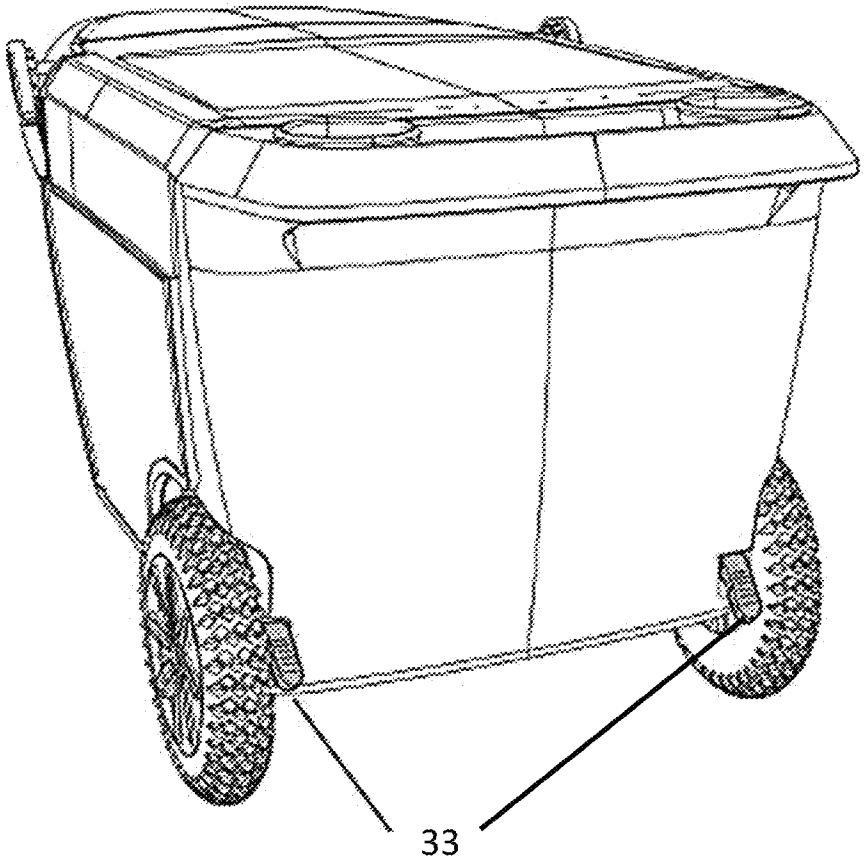
FIG. 11 is a view of the rear brake.
Figure 12:
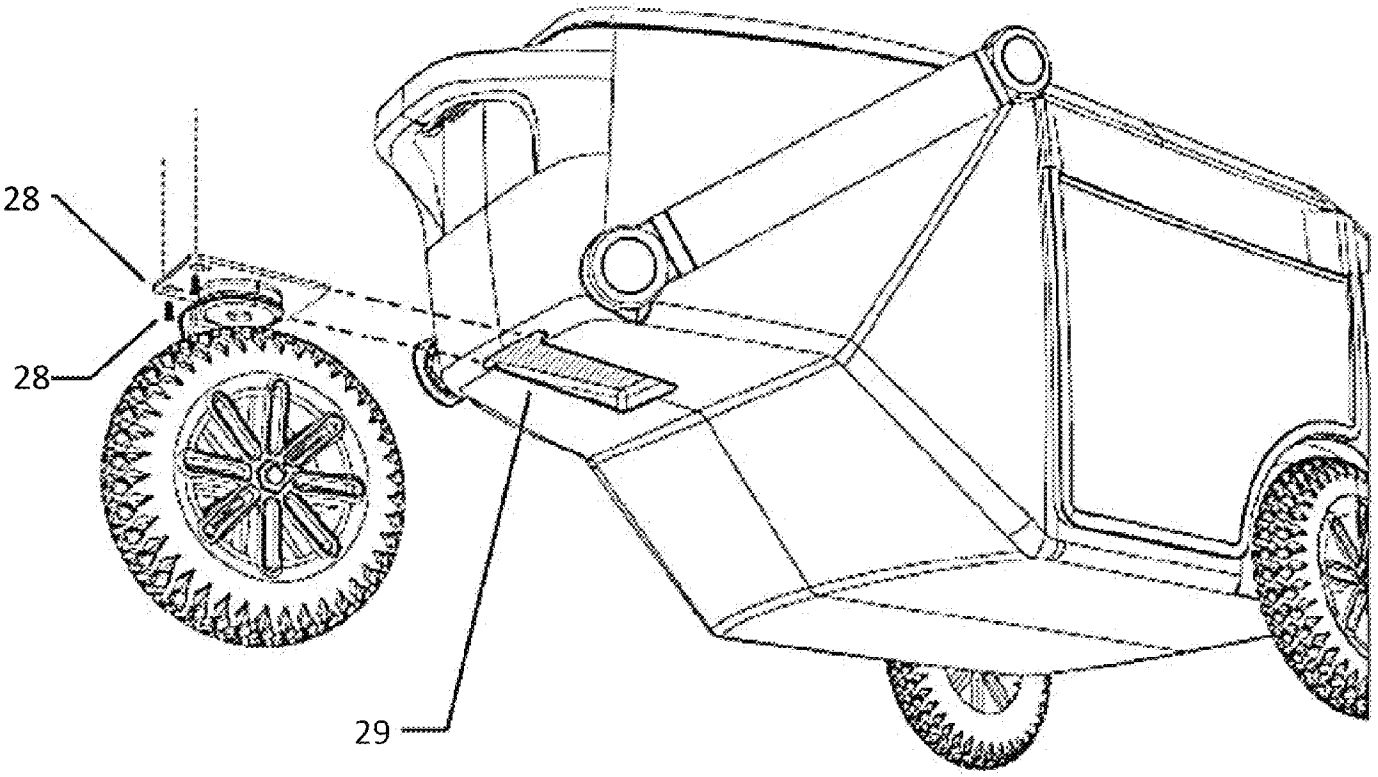
FIG. 12 is a view of an alternate attachment method for front sub-assembly.

FIGS. 9A, 9B, and 12 depict the front wheel swivel assembly. The swivel assembly mechanism is placed into a cavity 29 on the exterior body 10. The swivel assembly is comprised of a main pin 27, which is placed through an opening in the center of the top mounting plate 26. This mounting plate 26 is attached to the exterior body 10 with two reduced fastener counts 28.

Once the main pin 27 is through the top mounting plate 26, a primary load bearing 25 slides over the main pin 27. After the primary load bearing 25 is placed over the main pin 27, the main pin 27 is placed through an opening at the top of the single sided horn 18. Once the main pin 27 is through the single sided horn 18, a secondary load bearing 24 is placed over the main pin 27, followed by a retainer 23. All of the above are secured in place with a main pin nut 21, which is screwed on to the end of the main pin 27.

To secure the wheel to the single sided horn 18, an axle bolt 22 slides through a spanner bushing 20. The spanner bushing 20 is secured by screwing an axle nut 19 on the end of the axle bolt 22. The axle bolt 22 and spanner bushing 20 slide through an opening in bottom of the single sided horn 18.

Figure 13:
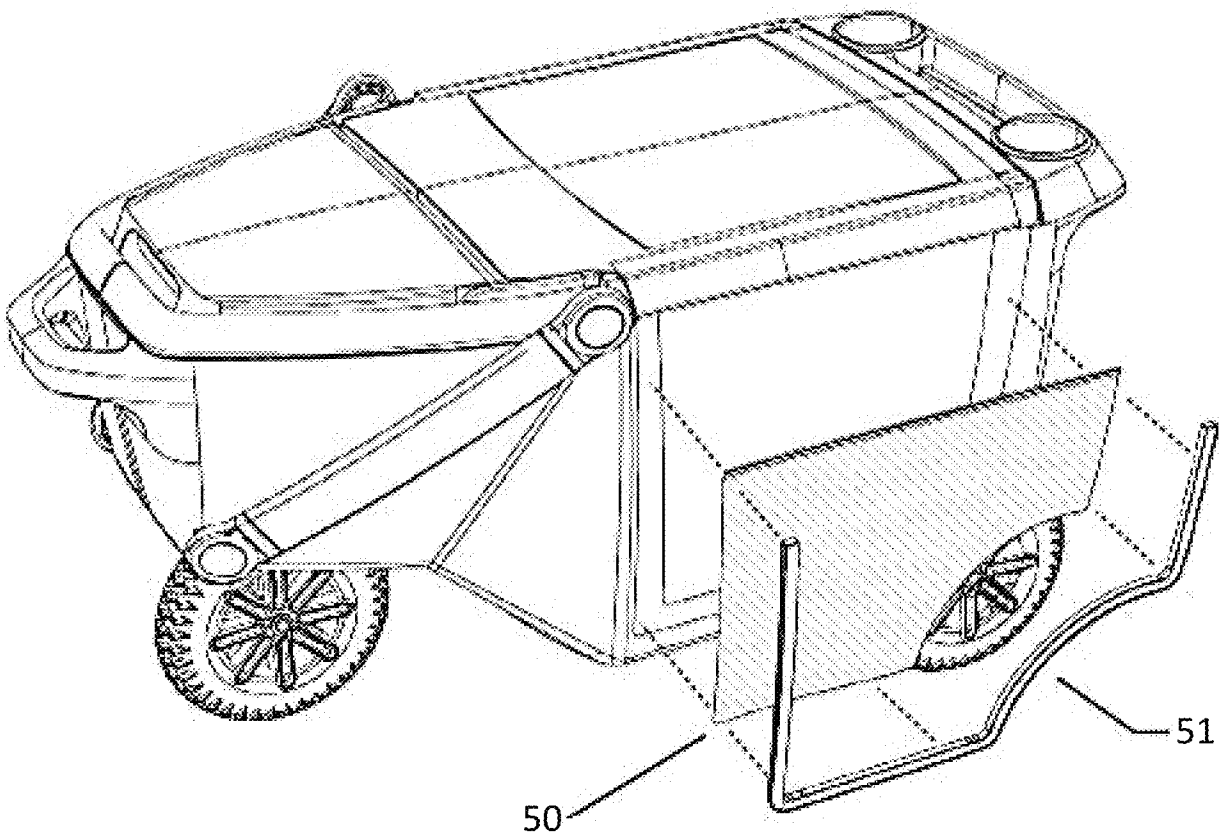
FIG. 13 is a view of the side mesh pocket of the instant system.

FIG. 13 depicts an alternative method for attaching the side mesh pockets. The primary attachment method is that the mesh pocket 50 is fastened or riveted to the exterior body 10. The alternative embodiment would have the mesh pocket 50 secured to the exterior body 10 with a plastic bracket 51.

Moreover, the optimal features of the instant system focus on utilization of the functional properties of large diameter, dense rubberize wheels and enhanced ground clearance. The enhanced sized of the wheel mechanisms, when compared with concurrent systems, and the axle placement of the rear wheels, particularly when taken in conjunction with the freely mounted and freely rotating, singular lead or front wheel, allow for enhanced ground clearance. The rear axle 32 may be strategically mounted on the lower edge of the body 10 such that ground clearance is strongly enhanced, particularly in light of the flexibility and rotational capabilities of the freely mounted front wheel.

Figure 14B:
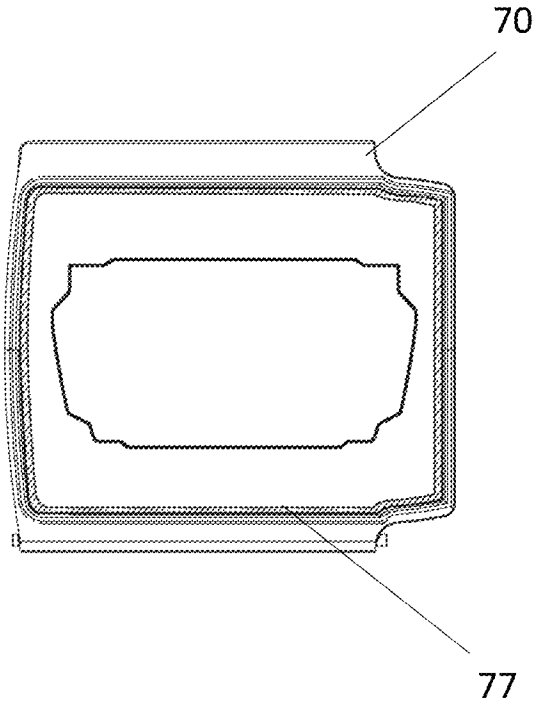
FIG. 14B is a bottom view of a lid seal gasket of the instant system deployed at the primary lid. The lid seal gasket may also be included on the secondary lid in additional embodiments.
Figure 14A:
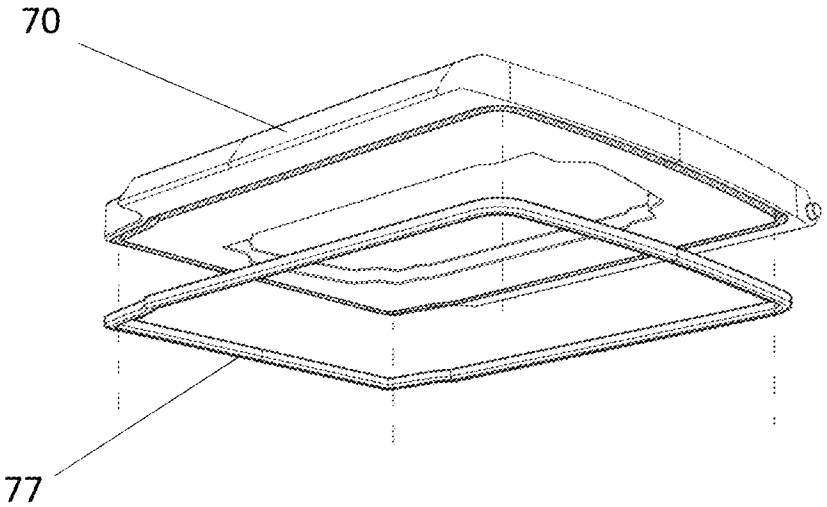
FIG. 14A is an isometric view of a lid seal gasket of the instant system deployed at the primary lid. The lid seal gasket may also be included on the secondary lid in additional embodiments.

In an additional embodiment, FIG. 14A is an isometric view of the lid seal gasket 77 of the instant system deployed at the primary lid. The lid seal gasket 77 may also be included on the secondary lid in additional embodiments. Additionally, FIG. 14B is a bottom view of the lid seal gasket 77 of the instant system deployed at the primary lid.

Figure 15A:
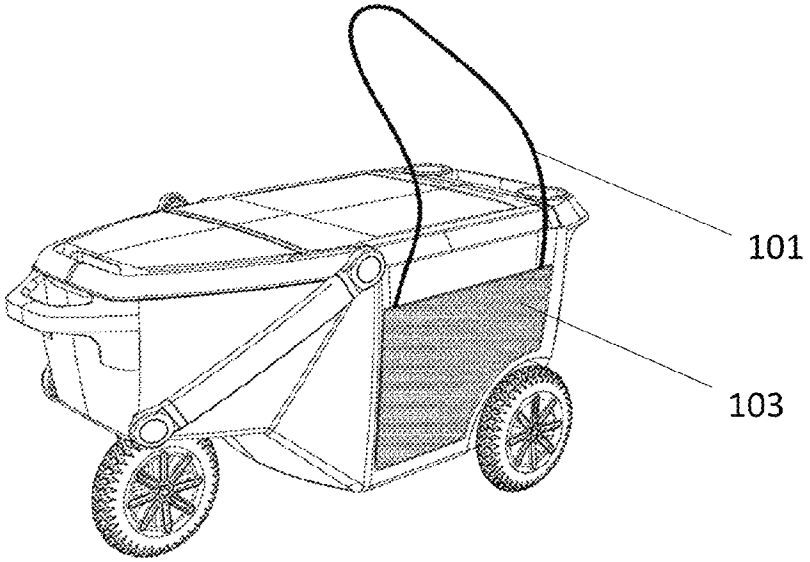
FIG. 15A is an isometric view of the instant system illustrating an integrated adjustable elastic tie-down strap in a loosened configuration. Further illustrated is the side mesh pocket for storage of the elastic tie-down strap when not in use.
Figure 15B:
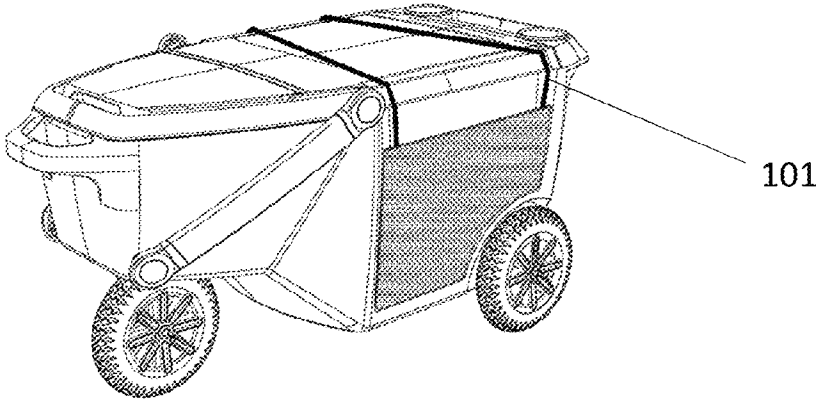
FIG. 15B is an isometric view of the instant system illustrating an integrated adjustable elastic tie-down strap in a tightened configuration.

In a further embodiment, FIG. 15A is an isometric view of the instant system illustrating an integrated adjustable elastic tie-down strap 101 in a loosened configuration. Further illustrated is the side mesh pocket 103 for storage of the elastic tie-down strap 101 when not in use. FIG. 15B is an isometric view of the instant system illustrating an integrated adjustable elastic tie-down strap 101 in a tightened configuration.

Figure 16A:
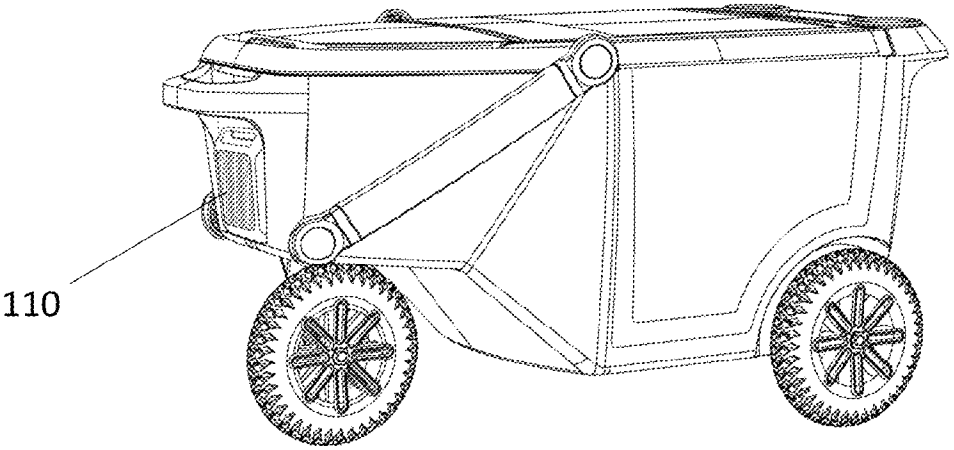
FIG. 16A is an isometric view of one embodiment of the instant system illustrating an integrated, removable, waterproof and rechargeable Bluetooth® speaker system that is Smartphone compatible in the attached position. The system may additionally include a USB port to support the charging of other devices such as smartphones and this USB port may be located under the front handle mechanism.
Figure 16B:
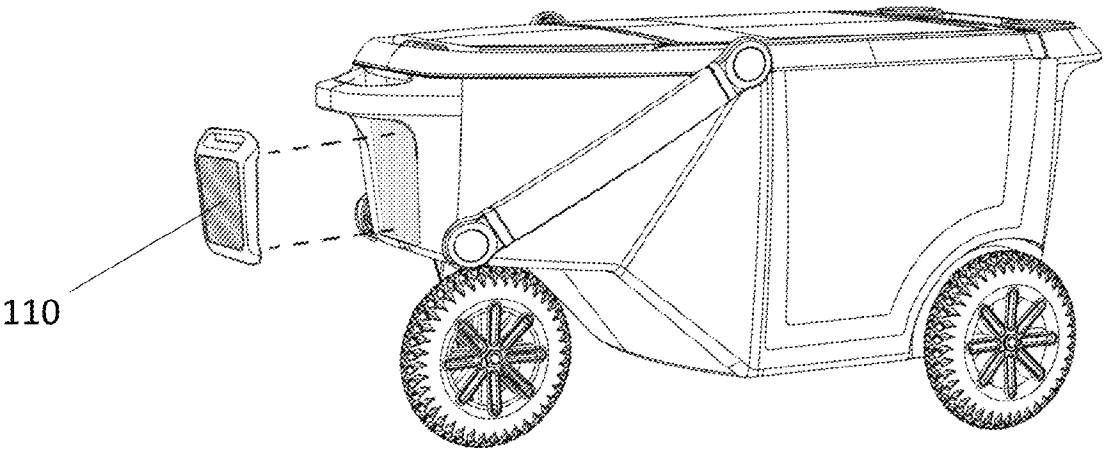
FIG. 16B is an isometric view of one embodiment of the instant system illustrating an integrated, removable, waterproof and rechargeable Bluetooth® speaker system that is Smartphone compatible in the detached position.

FIG. 16A is an isometric view of another embodiment of the instant system illustrating an integrated, removable, waterproof and rechargeable Bluetooth® speaker system 110 that is Smartphone compatible in the attached position. The system may additionally include a USB port to support the charging of other devices such as smartphones and this USB port may be located under the front handle mechanism. FIG. 16B is an isometric view of one embodiment of the instant system illustrating an integrated, removable, waterproof and rechargeable Bluetooth® speaker system 110 in the detached position.

Figure 17:
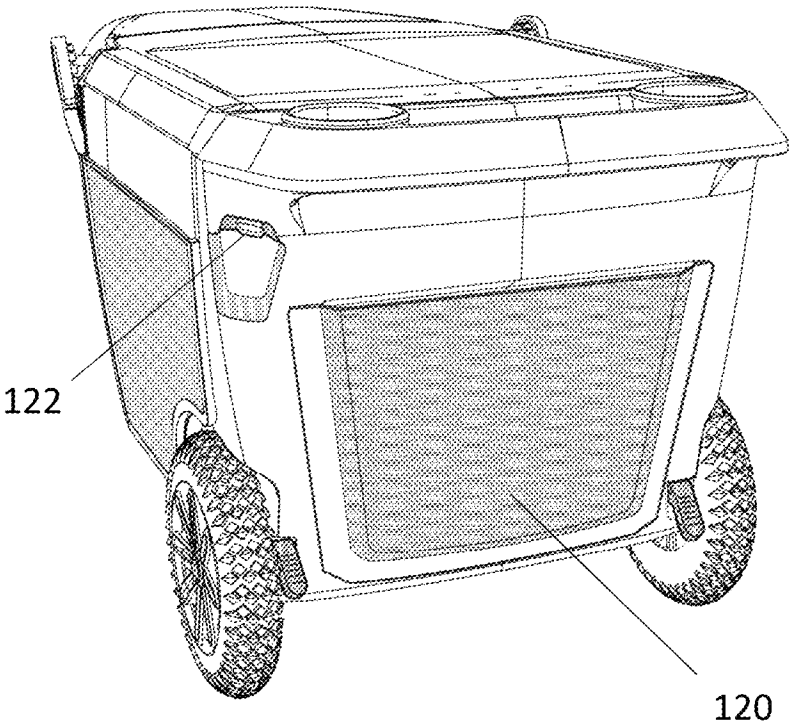
FIG. 17 is an isometric view of one embodiment of the instant system illustrating at least one, rearwardly disposed, integrated mesh storage pocket under the rear lift handle to increase overall storage capacity and further illustrates an integrated bottle opener in the rear handle.

FIG. 17 is an isometric view of an additional embodiment of the instant system illustrating at least one, rearwardly disposed, integrated mesh storage pocket 120 under the rear lift handle to increase overall storage capacity and further illustrates an integrated bottle opener 122 disposed on the rearward side and in proximity to the rear handle.

Figure 18B:
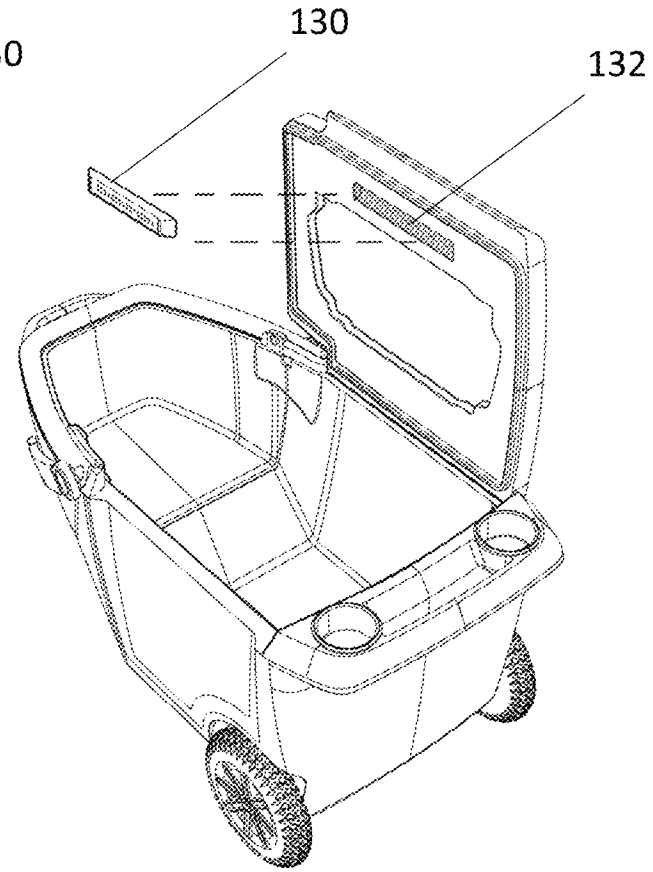
FIG. 18B is an isometric view of one embodiment of the instant system illustrating an integrated, removable, waterproof lighting system, removed from the underside of the main lid to be utilized as a flashlight.
Figure 18A:
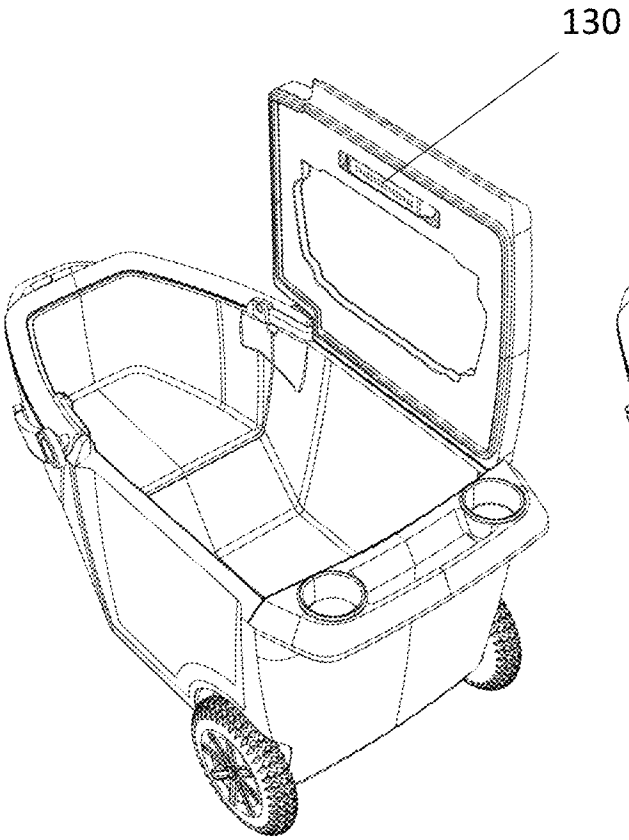
FIG. 18A is an isometric view of one embodiment of the instant system illustrating an integrated, removable, waterproof lighting system, located within the underside of the main lid. The waterproof lighting system will light the interior of the cooler as well as act as a flash light by removing.

FIG. 18A is an isometric view of one embodiment of the instant system illustrating an integrated, removable, waterproof lighting system 130 located within a cavity 132 the underside of the main lid. The waterproof lighting system will light the interior of the cooler as well as act as a flash light by removing. FIG. 18B is an isometric view of one embodiment of the instant system illustrating an integrated, removable, waterproof lighting system 130, removed from the underside of the main lid to be utilized as a flashlight.

There has thus been outlined, rather broadly, the more important features of the insulated rolling cooler in order that the detailed description thereof that follows may be better understood, and in order that the present contribution to the art may be better appreciated. There are additional features of the system that will be described hereinafter and which will form the subject matter of the claims appended hereto.

In this respect, before explaining at least one embodiment of the system in detail, it is to be understood that the system is not limited in its application to the details of construction and to the arrangements of the components set forth in the following description or illustrated in the drawings. The system is capable of other embodiments and of being practiced and carried out in various ways. Also, it is to be understood that the phraseology and terminology employed herein are for the purpose of description and should not be regarded as limiting.

These together with other objects of the system, along with the various features of novelty, which characterize the system, are pointed out with particularity in the claims annexed to and forming a part of this disclosure. For a better understanding of the system, its operating advantages and the specific objects attained by its uses, reference should be made to the accompanying drawings and descriptive matter in which there are illustrated preferred embodiments of the system.

What is claimed is:

1. An insulated rolling cooler apparatus comprising:

an exterior body member comprising:

a primary lid; and, a secondary lid;

at least one front wheel member;

at least two rear wheel members;

at least two braking mechanisms wherein at least one of the at least two braking mechanisms are in mechanical communication with each individual of the at least two rear wheel members;

at least two pockets;

at least two cup holders disposed on the upper side of the exterior body member;

a retractable multi-link handle mechanism;

a control arm in communication with the retractable multi-link handle mechanism, wherein the control arm comprises a cavity;

wherein the retractable multi-link handle mechanism mounts to the control arm is a hinge pivot, which allows the retractable multi-link handle mechanism to be in an opened or closed position; and an interior liner mechanism comprising a storage cavity comprising at least two interconnected compartments.

2. The insulated rolling cooler apparatus of claim 1, further comprising a towing mechanism extending from the front side of the exterior body member.

3. The insulated rolling cooler apparatus of claim 1, wherein the at least two pockets comprise a mesh construction.

4. The insulated rolling cooler apparatus of claim 1, wherein the storage cavity comprises at least two separate cavities.

5. The insulated rolling cooler apparatus of claim 1, wherein the interior liner further comprises:

at least one divider member; and, a molded recessed slot wherein the interior liner is disposed to receive the divider member and wherein the divider member is placed into a molded recessed slot in order to create the at least two separate cavities.

6. The insulated rolling cooler apparatus of claim 5, wherein the primary lid further comprises a storage cavity located on a lower side of the primary lid wherein the storage cavity is disposed to removably retain the divider member.

7. The insulated rolling cooler apparatus of claim 1, wherein the control arm comprises a hexacomb interior ribbing; and a cover member.

8. The insulated rolling cooler apparatus of claim 1, wherein the control arm comprises a detented rotation and adjustment mechanism comprising molded tabs members.

9. The insulated rolling cooler apparatus of claim 1, wherein the control arm cover member comprises a set of clips removably attached to the cavity on the control arm.

10. The insulated rolling cooler apparatus of claim 1, wherein the handle and the control arm are in rotational communication and wherein the control arm comprises a male end projection in communication with the detented rotation and adjustment mechanism of the control arm.

11. The insulated rolling cooler apparatus of claim 1, wherein the at least one front wheel has a swivel assembly mechanism wherein the at least one front wheel comprises 360 degrees of rotational angle.

12. The insulated rolling cooler apparatus of claim 11, wherein the swivel assembly mechanism comprises a set of components comprising:

a main pin;

a mounting plate;

at least two reduced fastener counts;

a primary load bearing;

a single sided horn;

a secondary load bearing;

a retainer;

a main pin nut;

an axle bolt;

a spanner bushing; and an axle nut.

13. The insulated rolling cooler apparatus of claim 12, further comprising:

a secondary load bearing located directly above the main pin; and, a retainer located directly above the secondary load bearing.

14. The insulated rolling cooler apparatus of claim 12 wherein the main pin nut is in threaded communication with the end of the main pin and secures the set of components.

15. The insulated rolling cooler apparatus of claim 12, where in the swivel assembly mechanism secures the at least one front wheel mechanism to the single sided horn.

16. A mobile containment apparatus comprising:

a body member;

a primary lid; and, a secondary lid;

at least two containment mechanisms;

at least two cup holders disposed on the upper side of an exterior of the body member;

a retractable multi-link handle mechanism; and, an interior liner mechanism comprising a storage cavity comprising at least two interconnected compartments;

an enhanced ground clearance motive system comprising:

at least one large diameter, dense rubberized freely rotating lead wheel;

at least two large diameter, dense rubberized wheels mounted on an axle located on the lower rear portion of a body mechanism;

at least two braking mechanisms wherein at least one of the at least two braking mechanisms are in mechanical communication with each individual of the at least two rear wheel members;

a lid seal gasket mechanism;

an integrated adjustable elastic tie-down strap;

an integrated removably attached, waterproof, rechargeable speaker system;

an integrated bottle opener; and, an integrated waterproof lighting system.

17. The mobile containment apparatus of claim 16 wherein the integrated, removable, waterproof lighting system is removably attached to the underside of the primary lid.

18. The mobile containment apparatus of claim 16 wherein the integrated adjustable elastic tie-down strap is stored in a mesh pocket mechanism.

* * * * *